US005089702A

United States Patent [19]

Allemann et al.

[11] Patent Number: 5,089,702

[45] Date of Patent: * Feb. 18, 1992

[54] ICR ION TRAP

[75] Inventors: Martin Allemann, Hinwil; Pablo Caravatti, Winterthur, both of Switzerland

[73] Assignee: Spectrospin AG, Switzerland

[ * ] Notice: The portion of the term of this patent subsequent to Jan. 1, 2008 has been disclaimed.

[21] Appl. No.: 612,481

[22] Filed: Dec. 12, 1990

Related U.S. Application Data

[63] Continuation of Ser. No. 460,938, filed as PCT/EP89/00751, Jun. 28, 1989, Pat. No. 4,982,087.

[30] Foreign Application Priority Data

Jun. 30, 1988 [DE] Fed. Rep. of Germany ..... 3821998

[51] Int. Cl.[5] ..... H01J 49/38

[52] U.S. Cl. ..... 250/291; 250/281; 250/282

[58] Field of Search ..... 250/291, 281, 282; 436/173

[56] References Cited

U.S. PATENT DOCUMENTS

| | | | |
|---|---|---|---|
| 4,588,888 | 5/1986 | Ghaderi | 250/291 |
| 4,686,365 | 8/1987 | Meek | 250/281 |
| 4,746,802 | 5/1988 | Kellerhals | 250/291 |
| 4,982,087 | 1/1991 | Allemann et al. | 250/291 |

FOREIGN PATENT DOCUMENTS 162649 5/1985 European Pat. Off. .

OTHER PUBLICATIONS

"Int. J. of Mass Spectr. and Ion Processes" 72 (1986), 33–51.

"ESN-European Spectroscopy News" 58 (1985), 16–18.

"Int. J. of Mass Spectr. and Ion Processes" 72 (1986), 63–71.

*Primary Examiner*—Jack I. Berman

*Attorney, Agent, or Firm*—Walter A. Hackler

[57] ABSTRACT

An ICR ion trap comprises electrically conductive side plates (1) extending in parallel to one axis (Z), and electrically conductive end plates (5,6) extending perpendicularly to the said axis (Z). Additional electrode plates (8,9) are arranged at a certain spacing from the said end plates (5,6) and can be supplied with trapping potentials of a polarity opposite to the polarity of the potentials applied to the said end plates so that an outer space is defined in which electrodes of opposite sign are trapped. Following analysis and elimination of the ions contained in the inner space, the ions of opposite sign can be trapped in the inner space for subsequent analysis. The arrangement provides also the possibility to observe recombination reactions between ions of different signs.

5 Claims, 1 Drawing Sheet

ICR ION TRAP

This application is a continuation of application Ser. No. 07/460,938, filed as PCT/EP89/00751, Jun. 28, 1989, now U.S. Pat. No. 4,982,087.

BACKGROUND OF THE INVENTION

The present invention relates to an ICR ion trap comprising electrically conductive side plates of equal axial length extending in parallel to one axis, and electrically conductive end plates extending perpendicularly to the said axis, closing the space defined by the said side plates and being electrically insulated from the latter, and a voltage source serving for applying trapping potentials to the side plates and end plates.

Ion traps of this kind have been used in ICR mass spectrometers and serve the purpose of trapping the ions of substances intended to be examined by mass spectroscopy, using the cyclotron resonance. For trapping negative ions, the end plates are in this case maintained at a negative potential, relative to the side plates, while for trapping positive ions the potential of the end plates must be positive relative to that of the side plates.

SUMMARY OF THE INVENTION

From the above it appears that with the known ICR ion traps the polarity of the potential of the end plates, relative to the side plates, determines the polarity of those ions that can be trapped by means of such an ion trap. If, as is usually the case, the ions are generated inside the ion trap by exposure of the substance to be examined to radiation, for example by application of a laser beam or an electron beam, then negative and positive ions may occur at the same time, in particular when an electron beam is applied, and of the two types of ions so obtained one will always be lost although it may absolutely be of interest to examine both types of ions. On the other hand, it may also be of interest to examine, by means of mass spectroscopy, any recombination reactions between positive and negative ions, but this the known ICR ion traps generally do not allow. Consequently, there exists a demand for ion traps which would permit to trap both positive and negative ions at the same time.

Now, it is the object of the present invention to provide an ion trap which enables positive and negative ions to be trapped at the same time.

This objective is achieved according to the invention by an ICR ion trap of the type described above wherein additional electrode plates arranged at a certain spacing from the said end plates extend in parallel to the latter and can be supplied, by means of the voltage source, with trapping potentials of a polarity opposite to the polarity of the potentials applied to the said end plates.

The ICR ion trap according to the invention, therefore, provides an arrangement where two areas forming ICR ion traps are sort of nested in each other. While the ions of the one polarity are trapped in the conventional manner between the end plates defining an inner area, the other ions are permitted to escape through holes provided in the end plates and to impinge upon the additional electrode plates defining an outer area. Having a polarity opposite to that of the end plates, the electrodes act to reflect these other ions and cause them to fly through the openings in the end plate and right to the other additional electrode plate where they are reflected again. Consequently, the ions having the other polarity are caused to traverse the inner area defined by the end plates and are permitted in this way to interact with the ions trapped within this area of the ion trap. Then recombination reactions, for example, may occur in this area the results of which may be studied subsequently by mass analysis of the ions trapped. Of course, there remains the fact that only negative or only positive ions can be detected at any time because only the ions trapped between the side plates, i.e. also between the end plates, can be excited to perform cyclotron movements so that they can be eliminated selectively. However, there always exists the possibility to change the voltages following the analysis of the ions of the one polarity, so that the ions of the other polarity, or at least a considerable portion thereof, can be transferred into and trapped in the ICR ion trap for subsequent analysis.

There have already been known ICR ion traps enabling positive and negative ions to be trapped at the same time. However, these ion traps operate according to a different principle and provide the drawbacks resulting therefrom. The first one of this known ion trap, which was the subject of a report presented by Ghaderi at the ASMS Meeting 1986 in Cincinnati/Ohio, makes use of an intentionally inhomogeneous magnetic field which renders the application of an electrostatic trapping field superfluous and which is similarly effective for both positive and negative ions. However, it is a disadvantage of this method that the lacking homogeneity sets very close limits to the resolution capabilities of a correspondingly designed spectrometer so that in any case high-resolution spectrometry is rendered practically impossible. According to another arrangement, which has been described by a paper by Inoue entitled "ICR Study of Negative Ions Produced by Electron Impact and Water Vapor", the ions are prevented from escaping by application of an rf voltage applied to the side plates of the ion traps. Consequently, this method is unsuited in all cases where broad-band Fourier transformation is to be employed.

The invention will now be described and explained in more detail by way of the embodiments illustrated in the drawing. The features appearing from the specification and the drawing may be employed in other embodiments of the invention either alone or in any desired combination thereof.

DETAILED DESCRIPTION

Figure 1:
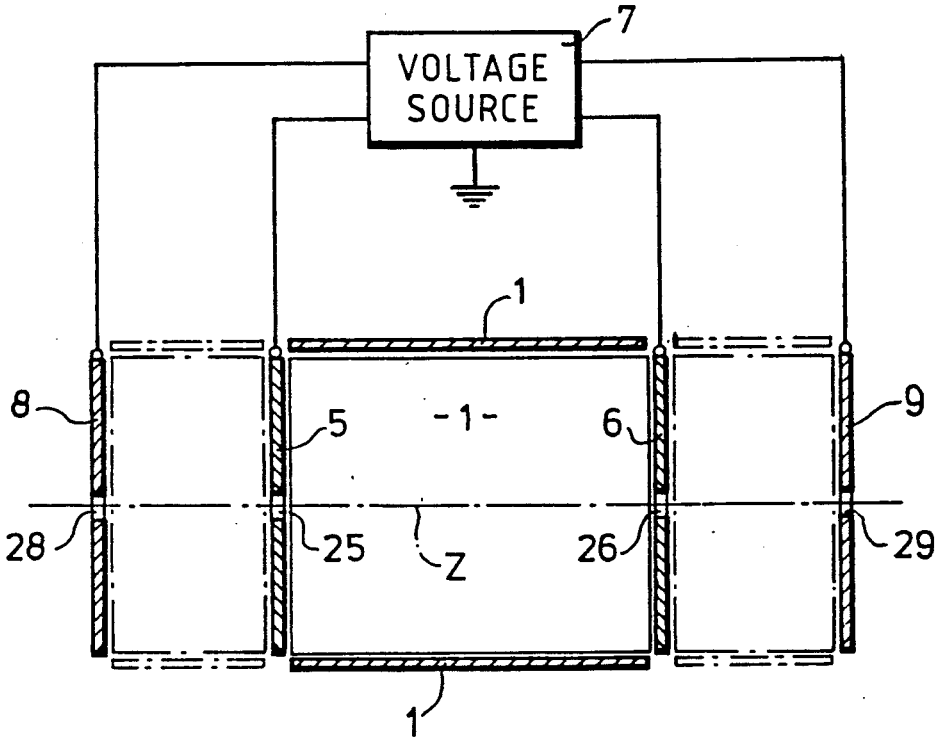
FIG. 1 shows a diagrammatic cross-section through an ICR trap according to the invention.
Figure 2:
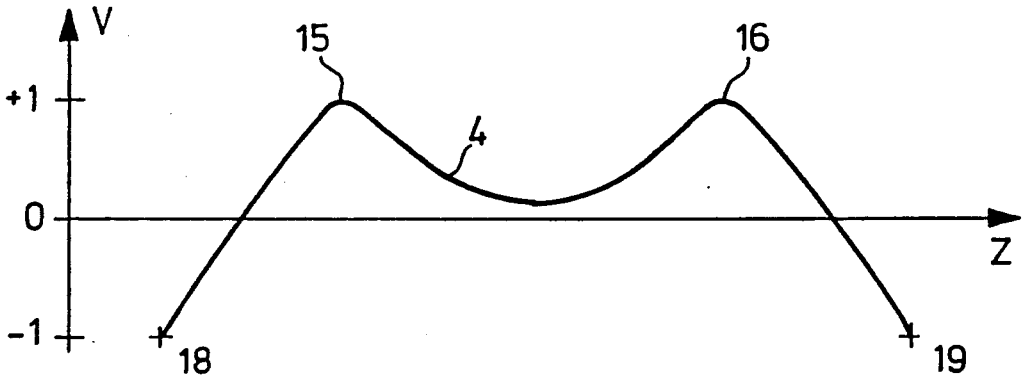
FIG. 2 shows a diagram representing the development of the potentials in the axial direction of the ion trap.

The ion trap illustrated in FIG. 1 comprises four side walls 1 three of which are visible in FIG. 1. The side walls 1 extend in parallel to an axis Z and define a prism of square cross-sectional shape. The ends of the prism are closed by two end plates 5, 6 which are supplied with a potential by a voltage source 7 and held by the latter at a defined, positive potential of +1 V relative to the side plates 1. Consequently, the potential development along the Z axis in the space defined by the side plates 1 and the end plates 5, 6 is that reflected by curve 4 in FIG. 2, between the maxima 15, 16. The ion trap offers insofar a conventional, typical design and is suited for trapping positive ions, as positive ions are reflected by the end plates 5, 6, which are held at a positive potential, and are, therefore, confined to the space between these end plates.

According to the invention, additional electrode plates 8, 9 extending in parallel to the end plates 5, 6 are arranged outwardly of the respective end plates 5, 6, relative to the side plates 1, and are spaced a certain, equal amount from the said end plates. As can be seen best in FIG. 2, these additional electrode plates 8, 9 are maintained at a potential of opposite sign, compared with the potential of the end plates 5, 6, i.e. in the illustrated embodiment at a potential of −1 V at any time. Consequently, one obtains between the end plates and the additional electrode plates the potential development represented by curve 4 in FIG. 2, between the end points 18 and 19 of the curve, and the respective maxima 15 and 16, respectively. Just as the positive end plates 5, 6 form a potential barrier for positive ions, the electrode plates 8, 9, which are maintained at a negative potential, form a potential barrier for negative ions. Consequently, any negative ions approaching the additional electrode plates 8, 9 will be reflected by the latter and, on the other hand, attracted by the end plates 5, 6. As a result of these conditions, the negative ions will pass through the central holes 25, 26 arranged in the end plates 5, 6 and approach the other additional electrode 9 where the negative ions are reflected once more so that, being accelerated by the neighboring end plate 6, they will fly through the space between the end plates 5, 6 until they are decelerated, and reversed as regards their direction of movement, by the additional electrode plate 8. The additional electrode plates 8, 9, therefore, form an ion trap for negative ions in the illustrated embodiment.

In mass analysis, however, only the positive ions trapped between the end plates 5, 6 can be analyzed in the case of the illustrated embodiment, because the analyzing pulse acts simultaneously to accelerate the negative ions which then describe circular paths which do no longer pass the holes 25, 26 in the end plates 5, 6. Consequently, negative ions are trapped in the spaces between the end plates 5, 6 and the respective neighboring additional electrode plates 8, 9. Upon termination of the analysis of the positive ions, it is then possible to reverse the potentials applied to the end plates 5, 6 and the other electrode plates 8, 9, respectively, which then results in a mirror-inverted curve of the potential development along the Z axis in FIG. 2, so that now the negative ions are trapped in the space defined by the end plates 5, 6 and are available for analysis. The ion loss encountered in this connection should be negligible.

In the case of the described arrangement, ionization of the substances present inside the ion trap may be effected by means of a laser or an electron beam passing the ICR ion trap in the direction of the Z axis. It is for this purpose that not only the end plates 5, 6 are provided with central holes 25, 26, but the additional electrode plates 8, 9 are provided with corresponding central holes 28, 29 as well. Of the ions formed under the impact of the laser or electron beam, the positive ions gather between the end plates 5, 6, in the represented embodiment, while the negative ions oscillate between the additional electrode plates 8, 9. In doing so, the negative ions traverse continuously the inner space filled with the positive ions so that interactions may easily occur between the positive and the negative ions. This makes the ICR ion trap according to the invention particularly well suited for observing interactions between positive and negative ions.

It goes without saying that the invention is not limited to the illustrated embodiment, but that deviations are possible without leaving the scope and intent of the invention. For example, it would be imaginable to design the side plates as parts of the surface of a cylinder, which means that the ICR ion trap could have a circular cross-section. In addition, it would be possible to arrange plate sections between the end plates and the additional electrode plates, in alignment with the side plates, as indicated by dash-dotted lines in FIG. 1 of the drawing. When using a laser beam, the latter may also be directed perpendicularly to the Z axis of the arrangement and, accordingly, to the axis of a magnetic field so that no holes would be required in the additional electrode plates 8, 9. In contrast, the central holes 25, 26 in the end plates 5, 6 would still be required to provide the necessary passage for the ions trapped between the additional electrode plates. It appears that there are many different possibilities for the man skilled in the art to realize an ICR ion trap according to the teachings of the invention which result from the content of the claims set out below.

Based on the usual geometrical dimensions of the homogeneous area of the magnetic field acting on the ICR cell, typical dimensions are 1 cm to 10 cm for the spacing between two oppositely arranged side plates 1, between 1 cm and 15 cm for the spacing between the end plates 5 and 6, between 1 cm and 10 cm for the spacing between each of the end plates 5 or 6 and its neighboring additional electrode plate 8, 9, and between 1 mm and 10 mm for the diameter of the central holes 25, 26, 28, 29. Typically, the spacing between each of the end plates 5 or 6 and its adjacent additional electrode plate 8 or 9 is three to five times the value of the diameter of the central holes 25, 26, 28, 29.

The trapping potentials are typically between −5 V and +5 V, the potentials applied to the end plates 5, 6 having the opposite sign relative to the potentials applied to the additional electrode plates 8, 9, but the same amount. However, it may under certain circumstances also be advantageous to apply to the additional electrode plates 8, 9 a trapping potential of greater or smaller value than that applied to the end plates 5, 6, for example in order to achieve a particular distribution in space of the electric field.

We claim:

1. An ICR ion trap comprising:

means defining an area bounded by a pair of spaced apart electrodes;

means for applying trapping potentials to said electrodes;

additional electrodes disposed outside said pair of spaced apart electrodes; and means for applying potentials to said additional electrodes of opposite polarity to the trapping potentials.

2. The ICR ion trap according to claim 1 further includes means for reversing the polarity of the potentials applied to the spaced apart electrodes and the additional electrodes.

3. The ICR ion trap according to claim 2 wherein the spaced apart electrodes and the additional electrodes include means defining holes therein arranged on a common axis for enabiing passage for ions trapped between the additional electrodes.

4. The ICR ion trap according to claim 3 wherein one additional electrode is disposed adjacent each spaced apart electrodes.

5. The ICR ion trap according to claim 4 wherein the spacing between each spaced apart electrode and the adjacent additional electrode is equal to between three and five times the diameter of the holes.

* * * * *